US011091911B1

(12) United States Patent
Schnabel et al.

(10) Patent No.: US 11,091,911 B1
(45) Date of Patent: Aug. 17, 2021

(54) MASONRY BLOCK FOR IN SITU INSULATION APPLICATION

(71) Applicants: Thomas James Schnabel, Littleton, CO (US); James B. Williams, Alexandria, SD (US)

(72) Inventors: Thomas James Schnabel, Littleton, CO (US); James B. Williams, Alexandria, SD (US)

( * ) Notice: Subject to any disclaimer, the term of this patent is extended or adjusted under 35 U.S.C. 154(b) by 0 days.

(21) Appl. No.: 15/485,321

(22) Filed: Apr. 12, 2017

(51) Int. Cl.

| | |
|---|---|
| ***E04C 1/39*** | (2006.01) |
| ***E04B 2/42*** | (2006.01) |
| ***E04B 1/76*** | (2006.01) |
| *E04B 2/02* | (2006.01) |

(52) U.S. Cl.
CPC ..... *E04C 1/39* (2013.01); *E04B 1/7604* (2013.01); *E04B 2/42* (2013.01); *E04B 2002/0291* (2013.01); *E04B 2103/02* (2013.01)

(58) Field of Classification Search
CPC ..... E04C 1/39; E04C 1/41; E04B 1/76; E04B 1/7604; E04B 2/42; E04B 2002/0295; E04B 2002/0293
See application file for complete search history.

(56) References Cited

U.S. PATENT DOCUMENTS 943,518 A * 12/1909 Butz ..... F16L 9/18 138/115
1,336,025 A * 4/1920 Cook ..... E04B 2/42 138/115
1,447,041 A * 2/1923 Roeth ..... E04B 2/42 52/505
2,852,933 A * 9/1958 Amundson ..... E04B 2/42 428/188
D245,340 S 8/1977 Johnson
4,123,881 A * 11/1978 Muse ..... E04B 2/44 52/100
4,566,238 A * 1/1986 Janopaul, Jr. ..... E04B 1/7604 52/404.3
4,769,964 A * 9/1988 Johnson ..... E04B 2/06 52/309.12
4,854,097 A 8/1989 Haener
5,209,037 A 5/1993 Kennedy
D340,772 S 10/1993 Harrison
6,305,135 B1 10/2001 Inaba
(Continued)

FOREIGN PATENT DOCUMENTS

EP 0003268 8/1979

*Primary Examiner* — Patrick J Maestri
(74) *Attorney, Agent, or Firm* — Holland & Hart LLP

(57) ABSTRACT

A masonry unit may include a main portion having end surfaces, a primary side surface, and a secondary side surface, and an auxiliary portion positioned adjacent to the main portion and defining an auxiliary void. The auxiliary portion may be connected to the main portion at the secondary side surface. The auxiliary portion may include an auxiliary wall being spaced from the secondary side surface to define the auxiliary void therebetween, and at least one bridging web extending across the auxiliary void and connecting the auxiliary wall to the main portion, the at least one bridging web being inset from the opposite ends of the unit, the at least one bridging web being integrally formed with the main portion and the auxiliary wall. The auxiliary void may extend from one end to another end of the unit and may extend from the top to the bottom of the unit.

17 Claims, 10 Drawing Sheets

(56) References Cited

U.S. PATENT DOCUMENTS

| | | | | |
|---|---|---|---|---|
| 6,978,581 | B1 | 12/2005 | Spakousky | |
| D527,113 | S | 8/2006 | Rainey | |
| 7,882,674 | B2 * | 2/2011 | Craven | E04B 2/18 446/124 |
| 8,516,775 | B2 | 8/2013 | Scheckler | |
| 9,366,028 | B1 | 6/2016 | Nickerson | |
| 9,422,713 | B2 | 8/2016 | Trebil | |
| 9,482,003 | B2 | 11/2016 | Browning | |
| 2008/0060300 | A1 * | 3/2008 | Westmoreland | E04C 1/41 52/405.4 |
| 2008/0104916 | A1 | 5/2008 | Schmid | |
| 2017/0145690 | A1 * | 5/2017 | Genest | E04C 1/39 |

* cited by examiner

MASONRY BLOCK FOR IN SITU INSULATION APPLICATION

BACKGROUND

Field

The present disclosure relates to masonry block and more particularly pertains to a new masonry block for in situ insulation application which may form a more complete and uninterrupted thermal and moisture barrier.

SUMMARY

In one aspect, the present disclosure relates to a masonry unit for forming a wall, and the unit has a top for orienting upwardly and a bottom for orienting downwardly, as well as opposite sides and opposite ends extending between the top and the bottom. The unit may comprise a main portion having at least one void extending from the top to the bottom of the unit, the main portion may have a pair of end surfaces, a primary side surface, and a secondary side surface. The surfaces of the main portion may extend between the top and bottom of the unit. The unit may comprise an auxiliary portion which is positioned adjacent to the main portion and defines an auxiliary void. The auxiliary portion may be connected to the main portion at the secondary side surface. The auxiliary portion may comprise an auxiliary wall spaced from the secondary side surface to define the auxiliary void therebetween. The auxiliary wall may extend substantially parallel to the secondary side surface of the main portion and the auxiliary void may be elongated in a direction substantially parallel to the secondary side face of the main portion. The auxiliary portion may also comprise at least one bridging web extending across the auxiliary void and connecting the auxiliary wall to the main portion, with the at least one bridging web being inset from the opposite ends of the unit. The at least one bridging web may be integrally formed with the main portion and to the auxiliary wall. The auxiliary void may extend from a first said opposite end of the unit to a second said opposite end of the unit and the auxiliary void extends from the top of the unit to the bottom of the unit.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
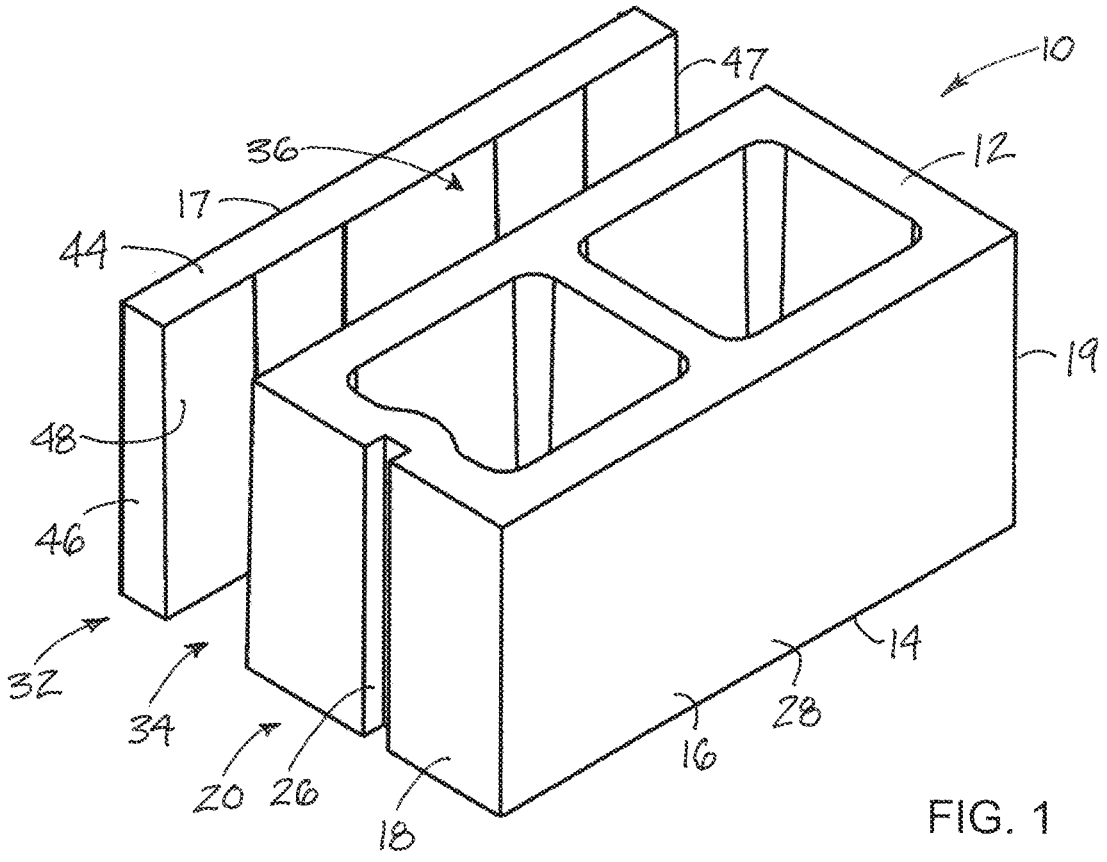
FIG. 1 is a schematic top perspective view of an embodiment of a new masonry unit according to the present disclosure.
Figure 2:
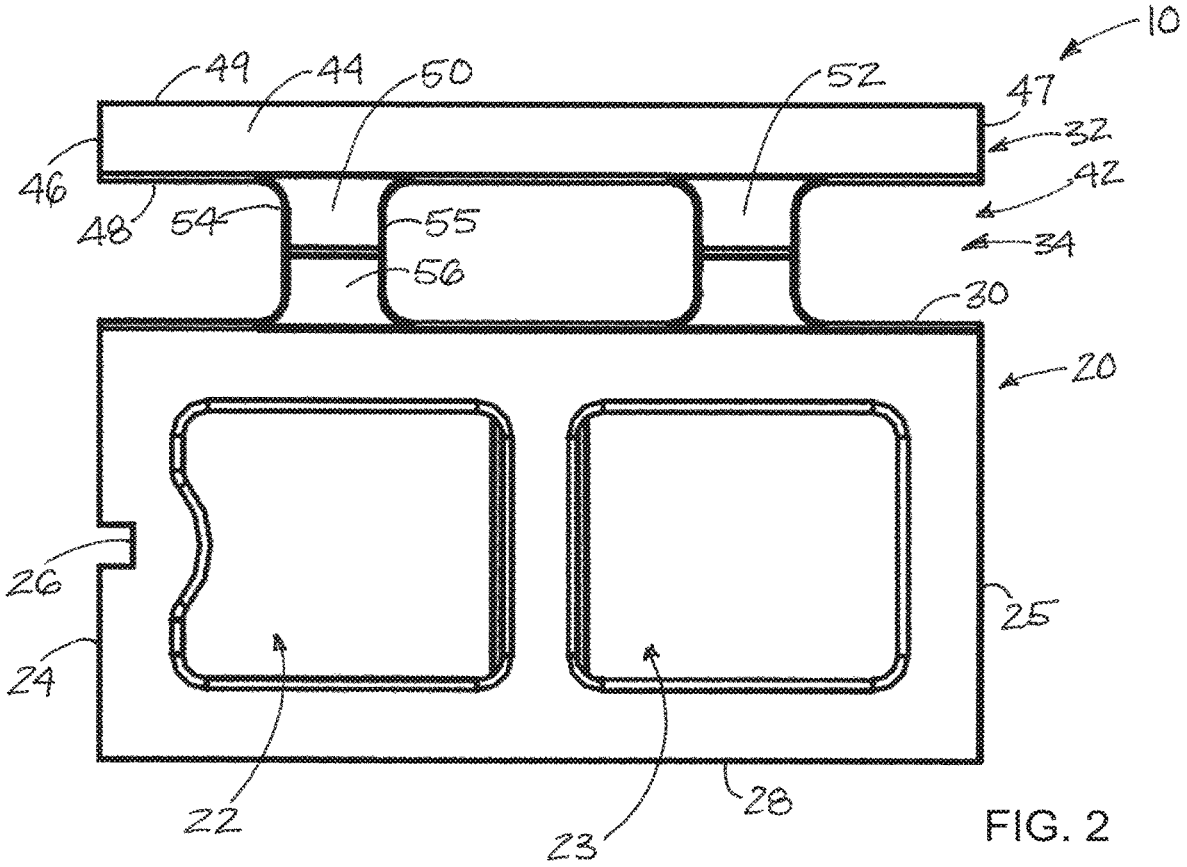
FIG. 2 is a schematic top view of the masonry unit, according to an illustrative embodiment.
Figure 3:
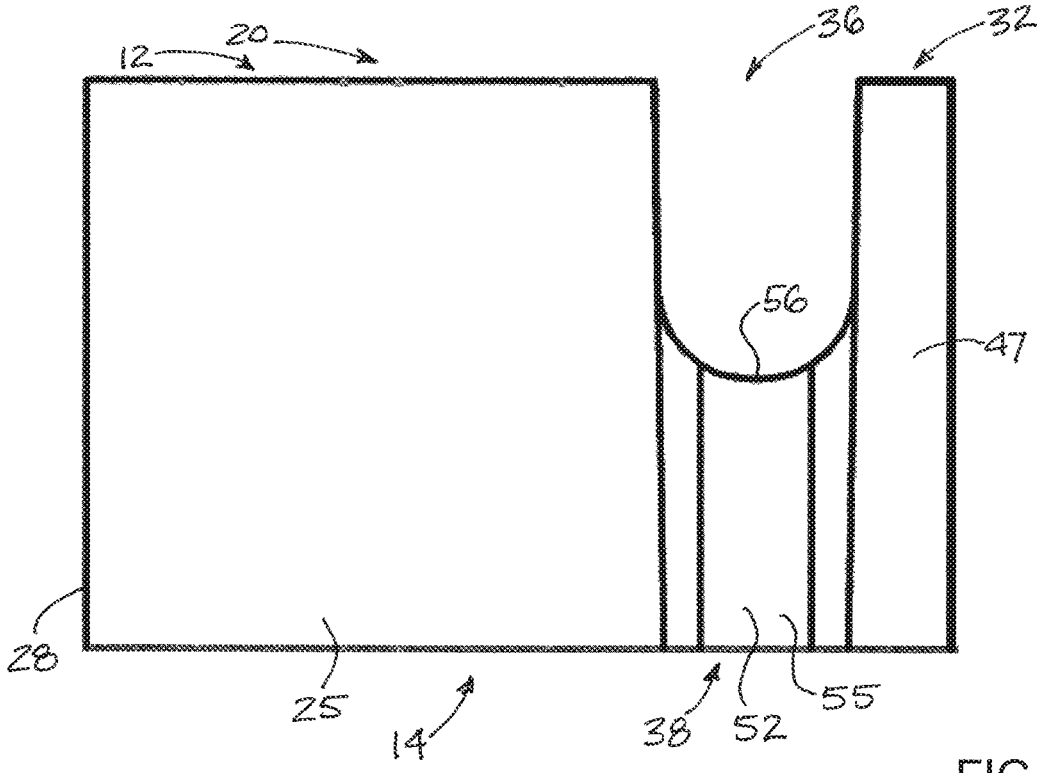
FIG. 3 is a schematic end view of the masonry unit, according to an illustrative embodiment.
Figure 4:
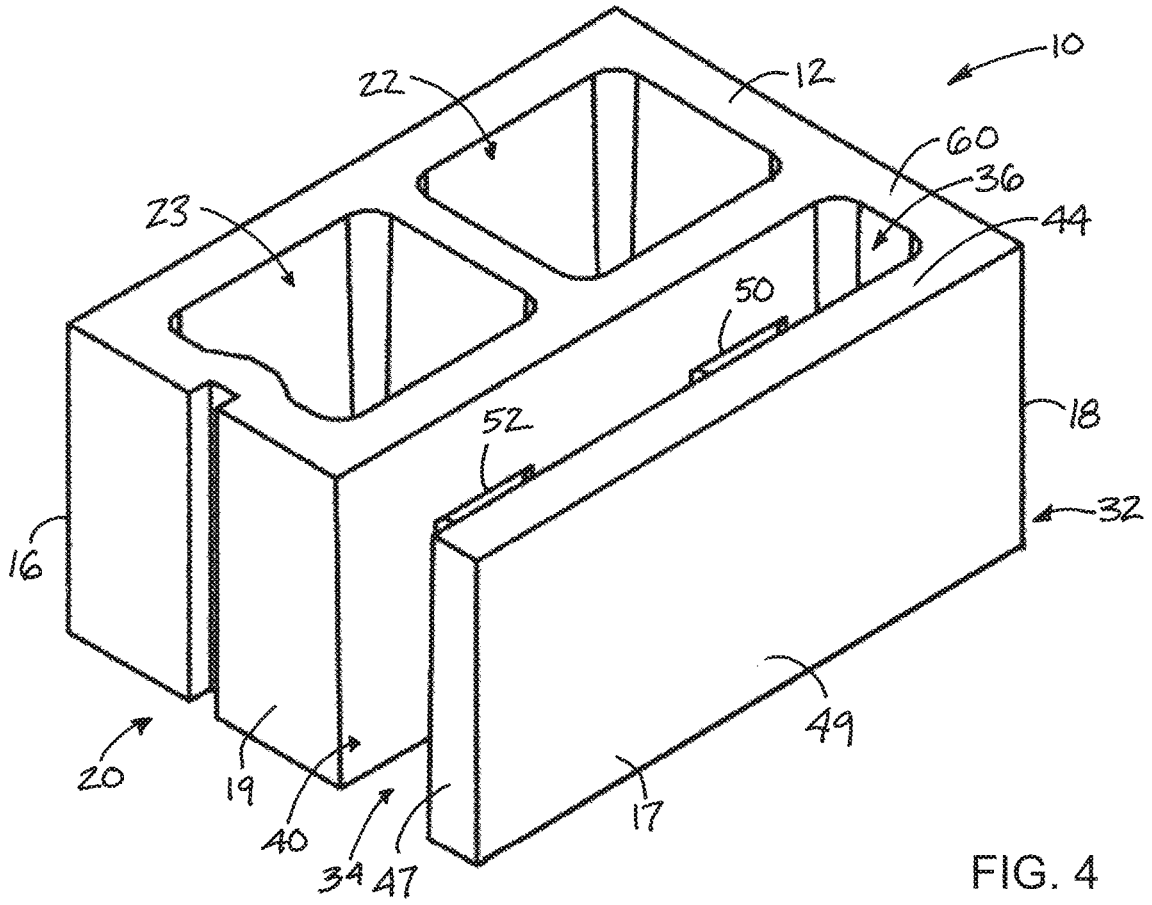
FIG. 4 is a schematic top perspective view of another embodiment of the masonry unit.
Figure 5:
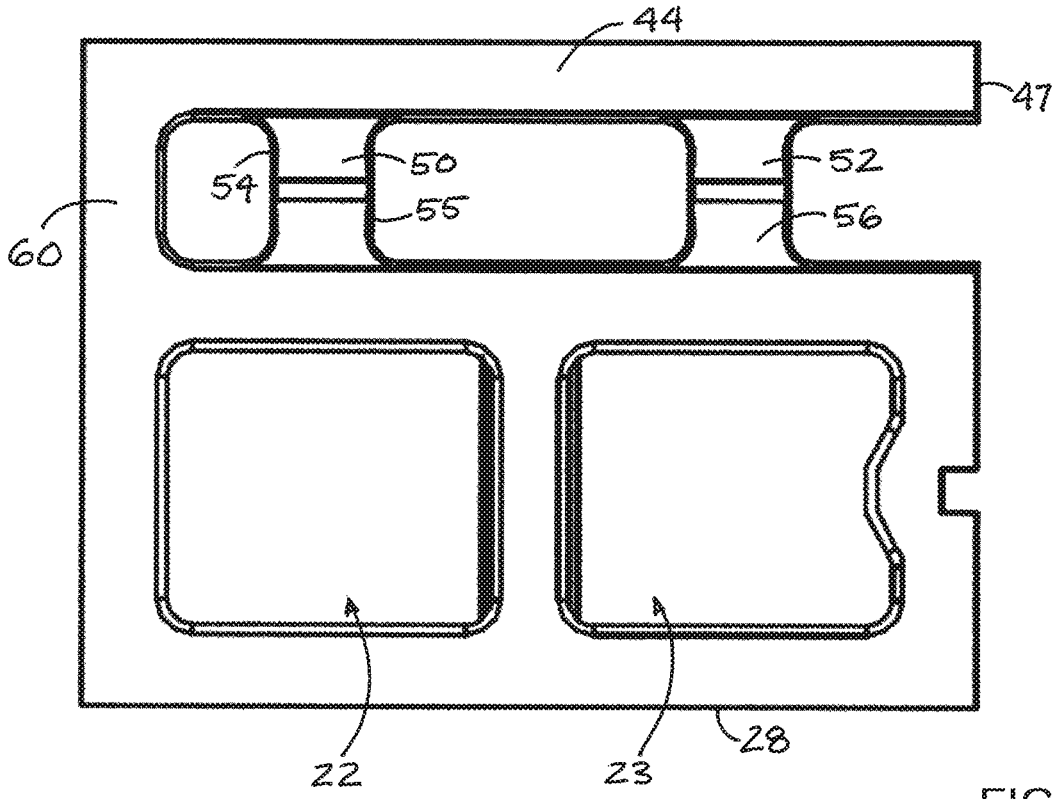
FIG. 5 is a schematic top view of the masonry unit, according to an illustrative embodiment.
Figure 6:
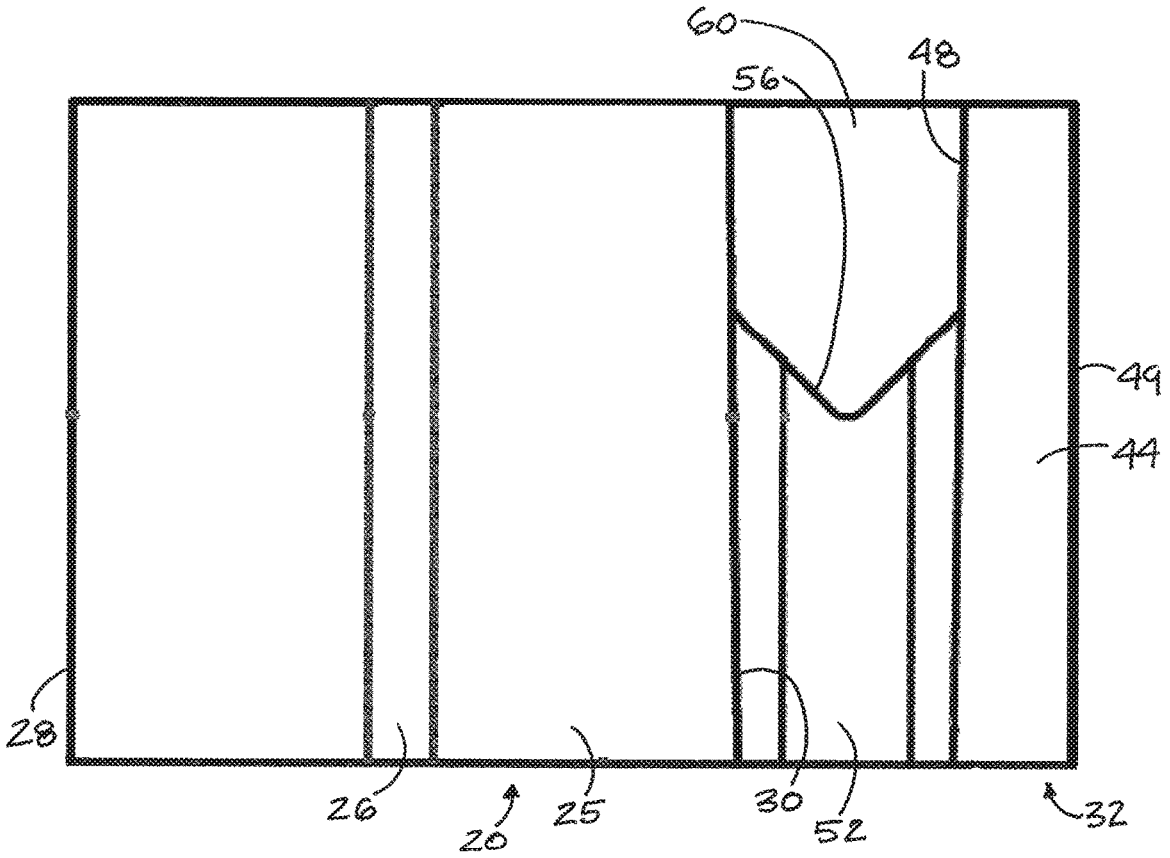
FIG. 6 is a schematic end view of the masonry unit, according to an illustrative embodiment.

With reference now to the drawings, and in particular to FIGS. 1 through 10 thereof, a new masonry block for in situ insulation application embodying the principles and concepts of the disclosed subject matter will be described.

While the use of insulating materials within masonry units or blocks forming a wall has been known, the applicants have recognized that the benefits of the known block designs have been limited by a number of factors. For example, applicants have realized that many of the known block designs retain the significant thermal bridges of conventional block between the exterior and interior surfaces of the blocks, and typically these thermal bridges are formed by the web and end walls that extend uninterrupted from the exterior to the interior surface of the block. Thus, simply positioning insulation in the voids of a conventional masonry unit, such as a cinder block, does not create a thermal break in the web and end walls extending between the exterior-facing and interior-facing sides of the block. As a further example, the applicants have recognized that various masonry unit designs in which preformed pieces of insulation are pre-inserted within voids of the masonry unit can fail to form a truly air- and moisture-tight barrier because the insulation pieces necessarily terminate at the edges of the masonry unit and often rely upon some type of physical abutment or interlock between the insulating pieces of the adjacent masonry units in order to form a barrier. Such structures thus require carefully fitting to form the barrier at the joints, and the softer insulating materials are vulnerable to damage when subjected to the real world environment of the construction jobsite, all of which can lead to improper engagement or interlock between the insulation and compromise the barrier.

The applicants have developed a masonry unit and method for use of the masonry unit which utilizes a masonry unit that may have some structure similar to conventional masonry units to provide the strength and familiarity of installation of conventional masonry units while incorporating structure that permits the placement of insulation material, such as an insulating foam, into the masonry unit after the masonry unit has been installed in a wall structure. The designs of the disclosure minimize the size of thermal bridges formed by the masonry material between the exterior- and interior-facing surfaces of the unit, while facilitating the flow of the insulating material into a void in the masonry unit which permits the insulating material to flow beyond the borders of the single masonry unit to adjacent masonry units in the wall structure to thus form a continuous barrier in the voids of adjacent masonry units to provide a highly effective thermal and moisture barrier. The void formed for the insulating material is thus in communication with the voids of units not only positioned in the wall above and below the unit, but also is in communication with units positioned in the wall at the ends of the unit in the same course as the unit.

In one aspect, the disclosure relates to a masonry unit 10 for forming a wall structure 1 in combination with a plurality of other units which may be of similar configuration. The unit 10 may have a top 12 for orienting upwardly and the bottom 14 for orienting downwardly when positioned for use in forming a wall. The unit 10 may also have opposite sides 16, 17 and opposite ends 18, 19 which extend between the top 12 and bottom 14. In some implementations, the side 16 may be on the interior-facing side 2 of the wall structure and the side 17 may be on the exterior-facing side 3 of the wall structure.

The masonry unit 10 may include a main portion 20 which may have one or more voids 22, 23 which extend between the top 12 and bottom 14 of the unit 10. The voids of the main portion may have openings at the top and the bottom of the masonry unit, but may otherwise be closed to the sides and ends of the unit 10. The main portion 20 may have a pair of end surfaces 24, 25, and in some embodiments at least one of the end surfaces may have a groove 26 extending between the top and bottom of the unit 10. The main portion 20 may also have a primary side surface 28 and a secondary side surface 30, and the side surfaces may extend between the top 12 and bottom 14. The side surfaces 28, 30 may also extend between the end surfaces 24, 25. The end 24, 25 and side 28, 30 surfaces may be substantially flat or planar, and the main portion 20 may have a substantially rectangular cubic configuration or shape. In some embodiments, the main portion may have nominal dimensions of approximately 8 inches in height by approximately 8 inches in width by approximately 16 inches in length. Illustrative actual dimensions of the main portion may be approximately 7⅝ inches in height by approximately 7⅝ inches in width by 16⅝ inches in length.

The masonry unit 10 may also include an auxiliary portion 32 positioned adjacent to the main portion 20, and more particularly to the secondary side surface 30 of the main portion. The auxiliary portion 32 may be spaced from the main portion to define an auxiliary void 34. The auxiliary void 34 may have an upper auxiliary opening 36 at the top 12 of the unit, a lower auxiliary opening 38 at the bottom 14 of the unit, and the upper and lower auxiliary openings may extend from one end 18 of the unit to another in 19 of the unit. The auxiliary void 34 may also have a first auxiliary end opening 40 located at a first end of the unit, and a second auxiliary end opening 42 located at a second end of the unit. The first and second auxiliary end openings may extend from the top of the unit to the bottom of the unit.

The auxiliary portion 32 may include an auxiliary wall 44 which may be spaced from the secondary side surface 30 of the main portion 20 in order to define the auxiliary void 34 therebetween. The auxiliary wall 44 may extend substantially parallel to the secondary side surface 30, and the auxiliary void may be locked elongated in a direction extending substantially parallel to the secondary side surface 30. The auxiliary wall 44 may have opposite ends 46, 47 and an inward side 48 and an outward side 49. The outward side 49 may form one of the sides 17 of the unit. The auxiliary wall 44 may extend from the top 12 to the bottom 14 of the unit, and from one end 18 to the other end 19 of the unit, and may have a height and length approximately equal to the main portion of the unit 10. In some illustrative embodiments, the auxiliary wall 44 may have a thickness of approximately 1¼ inches The auxiliary portion 32 may also include at least one bridging web 50 which connects the auxiliary wall 44 to the main portion 20. In some embodiments, two or more of the bridging webs 50, 52 are utilized to connect the auxiliary wall to the main portion. The bridging web or webs may be oriented substantially perpendicular to the secondary side surface 30 of the main portion 20. The bridging webs may be integrally formed with the main portion 20 and with the auxiliary wall 44. The presence of the bridging web or webs may divide the lower auxiliary opening 38 into two or more portions, but the portions of the opening may occupy more of the space between the ends than the web or webs.

Each of the bridging webs may have opposite bridging web surfaces 54, 55 which may be directed or oriented toward the ends 18, 19 of the masonry unit. At least one bridging web may be inset or indented from the end surfaces 24, 25 of the main portion and the ends of the unit 10, and the pair of bridging webs may be inset from the opposite ends, such that the auxiliary end openings are maximized in size.

Significantly, in some of the most preferred embodiments, such as shown in FIGS. 1 through 6, the height of the bridging web or webs (measured in a direction perpendicular to the planes of the top or bottom of the unit) is less than the height between the top 12 and bottom 14 of the unit. The bridging webs thus do not extend the full height of the block as defined by the distance between the top and bottom of the unit. As a result, the auxiliary void may extend from one end 18 of the unit 10 to the other and 19 of the unit with only partial interruption by the bridging webs. In some embodiments, the bridging web may extend upwardly from the bottom 14 of the unit toward the top, and the web may have an upper web surface 56 which is spaced from a plane defined by the top 12 of the unit, thus maximizing the size of the upper auxiliary opening and permitting communication between the spaces of the auxiliary void.

Figure 7:
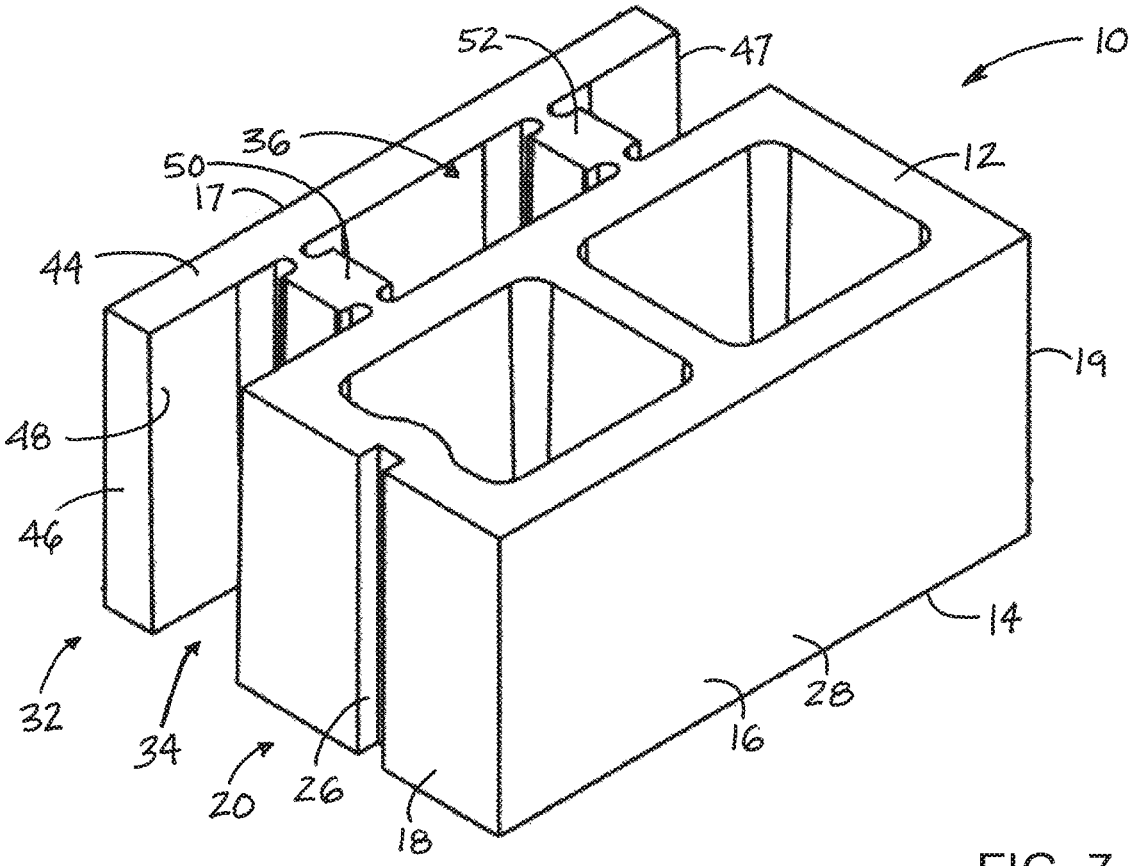
FIG. 7 is a schematic top perspective view of still another embodiment of the new masonry unit according to the present disclosure.
Figure 8:
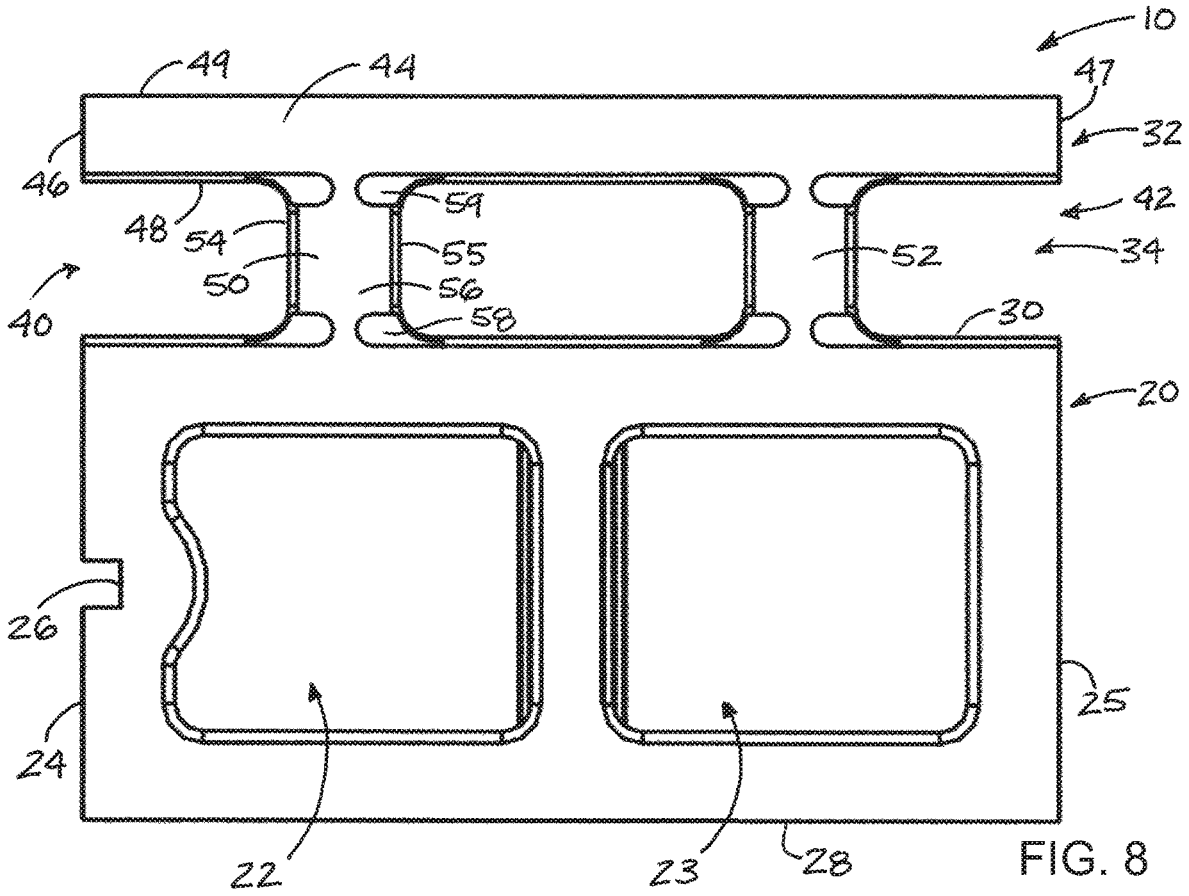
FIG. 8 is a schematic top view of the masonry unit shown in FIG. 7, according to an illustrative embodiment.
Figure 9:
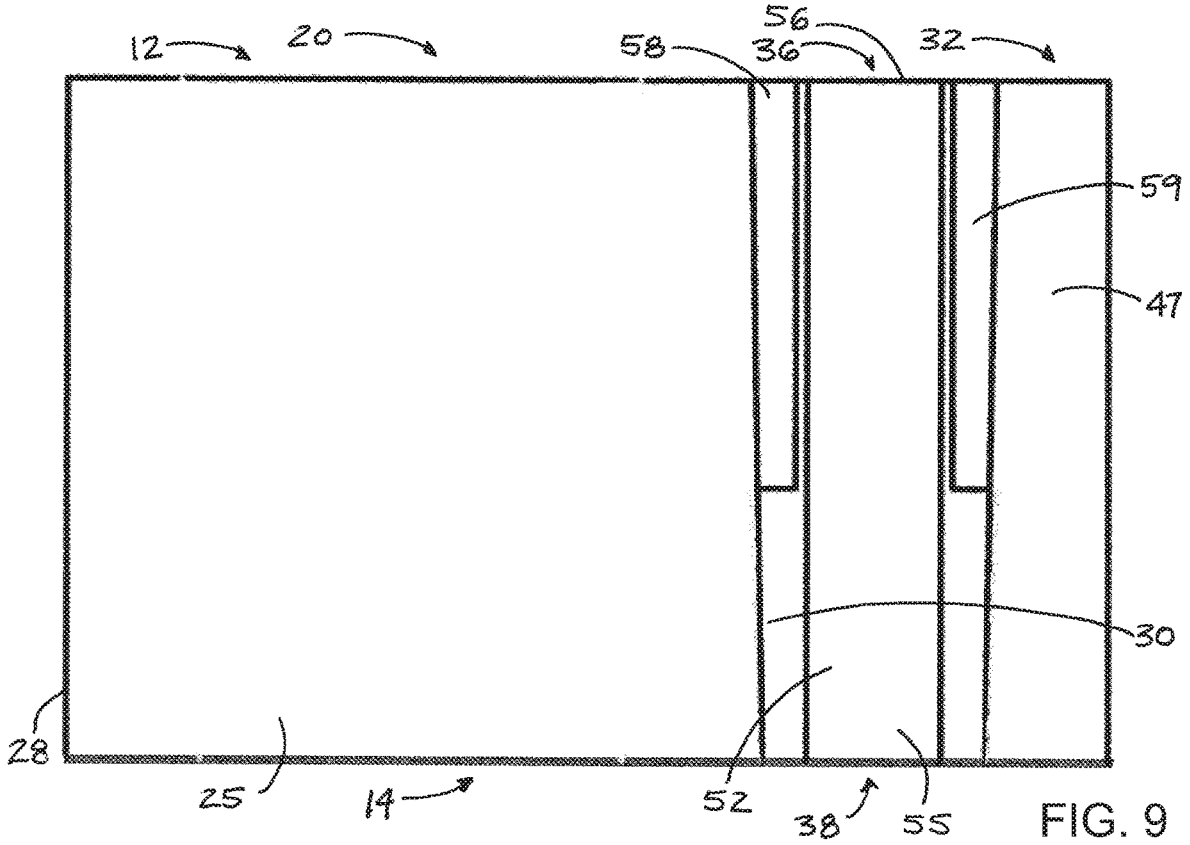
FIG. 9 is a schematic end view of the masonry unit shown in FIG. 7, according to an illustrative embodiment.
Figure 10:
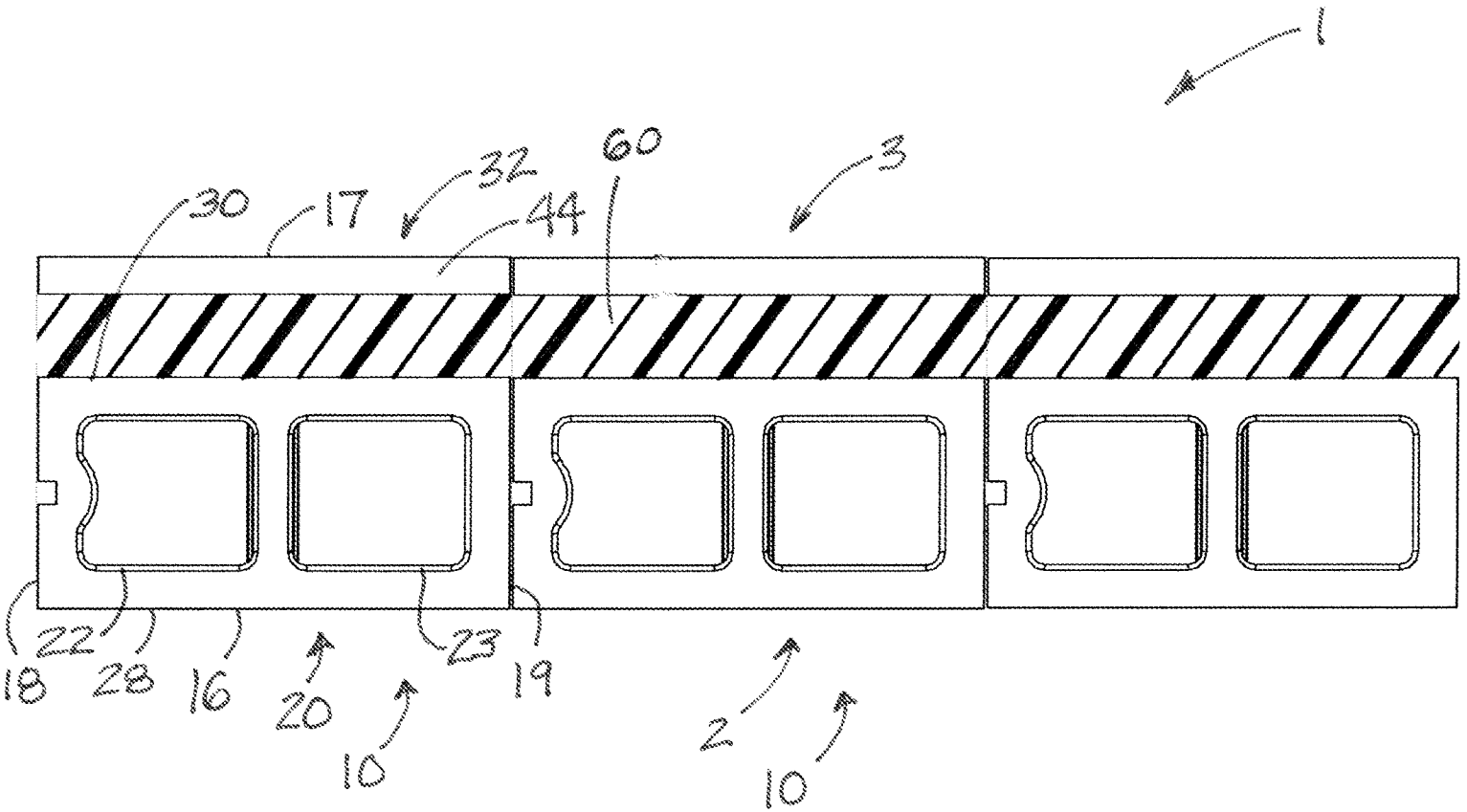
FIG. 10 is a schematic top view of a portion of a wall structure formed using the masonry units of the illustrative embodiments.

In some embodiments, a portion of the bridging web is structured to facilitate removal of the portion to reduce the height of the bridging web, such as is utilized in the embodiments shown in FIGS. 7 through 9. A pair of fracturing grooves 58, 59 may be formed on the bridging web with one or two of the grooves being positioned adjacent to the auxiliary wall and one or two of the grooves may be located adjacent to the secondary side surface of the main portion. The presence of the fracturing grooves on the portion of the bridging web may weaken the connection of the portion of the bridging web to the auxiliary wall and the main portion, and thus make removal of the portion easier to accomplish. In some embodiments, a portion of the bridging web that is approximately one half of the height of the masonry unit may be removable from a remainder of the bridging web by striking or otherwise fracturing the web along the preformed grooves and across the web.

In some embodiments, the main portion 20 of the unit 10 may have dimensions similar to conventional masonry block, so that the block retains the structural characteristics of conventional block regarding strength and dimensional size, and the auxiliary portion may be located or positioned outside of the conventional "footprint" of the masonry block. For example, some embodiments of the masonry unit 10 may have a main portion that measures approximately 8 inches in height by approximately 8 inches in width by approximately 16 inches in length (nominal dimensions), which are dimensions similar to conventional block, and the auxiliary portion may be positioned outside of that dimensional cube so that the overall dimensions of the masonry unit may measure approximately 8 inches in height by approximately 12 inches in width by approximately 16 inches in length (nominal dimensions). In such embodiments, the auxiliary void may have a width of approximately 23/4 inches, while having a height and length substantially equal to the height and length dimensions of the unit 10.

Since the auxiliary void 34 extends to both ends 18, 19 of the unit 10, as well as the top 12 and bottom 14 of the unit 10, the auxiliary void of one block is continuous or in communication with the auxiliary voids of the adjacent blocks in the wall structure so that insulation material 60 placed inside the auxiliary void of one of the units 10 is able to move to the auxiliary voids of adjacent units to form a barrier that is substantially continuous through the joints between the units. For example, in a wall assembled from multiple units 10, the lower auxiliary opening 38 of a first unit may be aligned with and in communication with the upper auxiliary opening 36 of a second unit positioned below the first unit in the wall, and the upper auxiliary opening 38 of the first unit may be aligned with and in communication with the lower auxiliary opening 36 of a third unit positioned above the first unit in the wall to permit movement of the insulation material 60 between the respective upper and lower auxiliary openings. Also, in a wall structure 1 of units 10, the first auxiliary end opening 40 of the first unit may be aligned with and in communication with the second auxiliary end opening 42 of a fourth unit positioned next to the end 18 of the first unit in the wall, and the second auxiliary end opening 42 of the first unit may be aligned with and in communication with the first auxiliary end opening 42 of a fifth unit positioned next to the end 19 of the first unit in the wall.

The design of some embodiments of the masonry unit 10 may facilitate use of the unit in special circumstances, such as at the end of a wall structure or at openings formed in the wall structure. For example, the embodiment of the masonry unit shown in FIGS. 4 through 6 of the drawings include an extension wall 60 which extends between the main portion 20 and the auxiliary wall 44 at one of the ends of the unit functions to form a termination of the auxiliary void 34 which may be effective to prevent insulation material from moving beyond the extension wall 60 in the wall structure being formed by the units 10.

In use, the units may be laid in the wall structure using conventional masonry techniques, and after one course, multiple courses, or even all courses, of the wall structure have been laid, an insulating material may be positioned in the auxiliary voids of the units. For example, the insulation material may be an expanding foam which is initially injected into the auxiliary voids of the lower courses of the wall structure and continuing on to the upper courses.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that steps set forth in the description and/or shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. An insulated masonry wall system, the system comprising:

a plurality of masonry units, each masonry unit having a top face, a bottom face, a first lateral face and a second lateral face, the unit further comprising:

a main portion with an interior-facing side oriented toward an interior of the wall system and an exterior-facing side oriented away from the interior of the wall system and two or more voids extending between the top and bottom faces of the masonry unit, wherein the main portion includes a main portion web extending between the top and bottom faces of the masonry unit and separating the two or more voids; and an auxiliary portion positioned adjacent to the main portion, the auxiliary portion including an auxiliary wall spaced from the exterior-facing side of the main portion in a substantially parallel manner by an auxiliary void extending from the top face of the masonry unit to the bottom face of the masonry unit, the auxiliary portion being connected to the main portion by at least one bridging web extending from the exterior-facing side of the main portion to the auxiliary wall, wherein the auxiliary void extends between the top and bottom faces and the first and second lateral faces of the masonry unit, wherein the at least one bridging web is offset from the first lateral face, the second lateral face, and the main portion web, and wherein a height of the bridging web of the masonry units is less than a height between the top and bottom faces of the masonry units such that the auxiliary voids extend continuously from one masonry unit to another laterally when stacked to form a wall; and a foam insulation injected into the auxiliary voids of the masonry units of the wall system, the foam extending between the top and bottom faces and first and second lateral faces of the plurality of masonry units to form a substantially continuous polyurethane foam layer positioned between the main portions and auxiliary portions of the masonry units of the wall system.

2. The insulated masonry wall system of claim 1, wherein the masonry units are configured to be stacked to form a wall such that the two or more voids of the main portions are substantially vertically continuous between units.

3. The insulated masonry wall system of claim 1, wherein the bridging webs of the masonry units are integrally formed with the main portions and the auxiliary walls of the masonry units.

4. The insulated masonry wall system of claim 1, wherein the bridging web extends upwardly from a plane defined by the bottom face of the masonry units toward the top face and terminates at an upper web surface spaced vertically below a plane defined by the top face of the unit.

5. The insulated masonry wall system of claim 1, wherein the masonry units include more than one bridging web.

6. The insulated masonry wall system of claim 5, wherein the masonry units include two bridging webs.

7. The insulated masonry wall system of claim 5, wherein the more than one bridging webs are oriented to be substantially perpendicular to the interior-facing side of the main portion of the masonry units.

8. The insulated masonry wall system of claim 5, wherein the more than one bridging web has a height and the auxiliary wall has a height, and wherein the height of the auxiliary wall is approximately twice the height of the bridging web.

9. The insulated masonry wall system of claim 1, wherein the foam insulation is a polyurethane foam insulation.

10. An insulated masonry wall system, the system comprising:

a plurality of masonry units, each masonry unit having a top face, a bottom face, a first lateral face and a second lateral face, the unit further comprising:

a main portion with an interior-facing side oriented toward an interior of the wall system and an exterior-facing side oriented away from the interior of the wall system and two or more voids extending between the top and bottom faces of the masonry unit, wherein the main portion includes a main portion web extending between the top and bottom faces of the masonry unit and separating the two or more voids; and an auxiliary portion positioned adjacent to the main portion, the auxiliary portion including an auxiliary wall spaced from the exterior-facing side of the main portion in a substantially parallel manner by an auxiliary void extending from the top face of the masonry unit to the bottom face of the masonry unit, the auxiliary portion being connected to the main portion by at least one bridging web integrally formed with the main portion and the auxiliary wall of the masonry unit, the bridging web extending from the exterior-facing side of the main portion to the auxiliary wall, wherein the auxiliary void extends between the top and bottom faces and the first and second lateral faces of the masonry unit, wherein the at least one bridging web is offset from the first lateral face, the second lateral face, and the main portion web, and wherein a height of the bridging web of the masonry units is less than a height between the top and bottom faces of the masonry units such that the auxiliary voids extend continuously from one masonry unit to another laterally when stacked to form a wall; and a foam insulation injected into the auxiliary voids of the masonry units of the wall system, the foam extending between the top and bottom faces and first and second lateral faces of the plurality of masonry units to form a substantially continuous polyurethane foam layer positioned between the main portions and auxiliary portions of the masonry units of the wall system;

wherein the masonry units are configured to be stacked to form a wall such that the two or more voids of the main portions are substantially vertically continuous between units.

11. The insulated masonry wall system of claim 10, wherein the bridging web extends upwardly from a plane defined by the bottom face of the masonry units toward the top face and terminates at an upper web surface spaced vertically below a plane defined by the top face of the unit.

12. The insulated masonry wall system of claim 10, wherein the masonry units include more than one bridging web.

13. The insulated masonry wall system of claim 12, wherein the masonry units include two bridging webs.

14. The insulated masonry wall system of claim 12, wherein the more than one bridging webs are oriented to be substantially perpendicular to interior-facing side of the main portion of the masonry units.

15. The insulated masonry wall system of claim 12, wherein the more than one bridging web has a height and the auxiliary wall has a height, and wherein the height of the auxiliary wall is approximately twice the height of the bridging web.

16. The insulated masonry wall system of claim 10, wherein the foam insulation is a polyurethane foam insulation.

17. An insulated masonry wall system, the system comprising:

a plurality of masonry units, each masonry unit having a top face, a bottom face, a first lateral face and a second lateral face, the unit further comprising:

a main portion with an interior-facing side oriented toward an interior of the wall system and an exterior-facing side oriented away from the interior of the wall system and two or more voids extending between the top and bottom faces of the masonry unit, wherein the main portion includes a main portion web extending between the top and bottom faces of the masonry unit and separating the two or more voids; and an auxiliary portion positioned adjacent to the main portion, the auxiliary portion including an auxiliary wall spaced from the exterior-facing side of the main portion in a substantially parallel manner by an auxiliary void extending from the top face of the masonry unit to the bottom face of the masonry unit, the auxiliary portion being connected to the main portion by at least one bridging web integrally formed with the main portion and the auxiliary wall of the masonry unit, the bridging web extending from the exterior-facing side of the main portion to the auxiliary wall, wherein the auxiliary void extends between the top and bottom faces and the first and second lateral faces of the masonry unit, wherein the at least one bridging web is offset from the first lateral face, the second lateral face, and the main portion web, and wherein a height of the bridging web of the masonry units is less than a height between the top and bottom faces of the masonry units such that the auxiliary voids extend continuously from one masonry unit to another laterally when stacked to form a wall; and a polyurethane foam insulation injected into the auxiliary voids of the masonry units of the wall system, the foam extending between the top and bottom faces and first and second lateral faces of the plurality of masonry units to form a substantially continuous polyurethane foam layer positioned between the main portions and auxiliary portions of the masonry units of the wall system;

wherein the masonry units are configured to be stacked to form a wall such that the two or more voids of the main portions are substantially vertically continuous between units.

* * * * *